US009704683B2

(12) United States Patent
Schmelz

(10) Patent No.: US 9,704,683 B2
(45) Date of Patent: Jul. 11, 2017

(54) DOUBLE-BREAK RELAY

(71) Applicant: Gruner AG, Wehingen (DE)

(72) Inventor: Rainer Schmelz, Wellendingen (DE)

(73) Assignee: Gruner AG, Wehingen (DE)

( * ) Notice: Subject to any disclaimer, the term of this patent is extended or adjusted under 35 U.S.C. 154(b) by 0 days.

(21) Appl. No.: 14/944,108

(22) Filed: Nov. 17, 2015

(65) Prior Publication Data

US 2016/0071676 A1 Mar. 10, 2016

Related U.S. Application Data

(63) Continuation of application No. PCT/EP2014/057713, filed on Apr. 16, 2014.

(30) Foreign Application Priority Data

May 24, 2013 (DE) ..... 10 2013 209 688.7

(51) Int. Cl.

| | |
|---|---|
| ***H01H 50/56*** | (2006.01) |
| ***H01H 1/26*** | (2006.01) |
| ***H01H 50/20*** | (2006.01) |
| ***H01H 50/58*** | (2006.01) |
| *H01H 1/20* | (2006.01) |
| *H01H 50/54* | (2006.01) |
| *H01H 50/64* | (2006.01) |

(52) U.S. Cl.

CPC ..... *H01H 50/56* (2013.01); *H01H 1/26* (2013.01); *H01H 50/20* (2013.01); *H01H 50/58* (2013.01); *H01H 1/20* (2013.01); *H01H 50/546* (2013.01); *H01H 50/641* (2013.01)

(58) Field of Classification Search

CPC ..... H01H 1/26; H01H 50/56; H01H 50/58; H01H 50/20; H01H 50/546; H01H 1/20; H01H 50/641

See application file for complete search history.

(56) References Cited

U.S. PATENT DOCUMENTS 2,434,186 A * 1/1948 Wilson ..... H01H 50/20 361/99
2,539,547 A * 1/1951 Mossman ..... H01H 50/20 335/151

(Continued)

FOREIGN PATENT DOCUMENTS

DE 15 15 640 B1 1/1971
DE 32 17 528 A1 11/1983

(Continued)

*Primary Examiner* — Mohamad Musleh
(74) *Attorney, Agent, or Firm* — Hacker Daghighian Martino & Novak

(57) ABSTRACT

A relay for closing or interrupting the electric circuit between two relay connection contacts includes two contact springs which are each fixed in an electrically conductive manner to the relay connection contacts with the spring ends thereof facing away from each other and which face each other with the other free, deflectable spring ends thereof. A stationary, electrically conductive contact bridge, against which the free spring ends abut in the closed relay position and from which the free spring ends are lifted in the open relay position, is included. A single solenoid-operated mechanism is for the synchronous, parallel deflection of the two contact springs into the closed or open relay position.

9 Claims, 3 Drawing Sheets

(56) References Cited

U.S. PATENT DOCUMENTS

| | | | | |
|---|---|---|---|---|
| 3,103,563 | A * | 9/1963 | Grenier | H01H 1/20 335/145 |
| 3,602,850 | A * | 8/1971 | Grunert | H01H 50/546 335/133 |
| 5,917,394 | A * | 6/1999 | Fuchs | H01H 50/045 335/126 |
| 6,677,840 | B2 | 1/2004 | Nakamura | |
| 2015/0206684 | A1* | 7/2015 | Naka | H01H 50/60 335/187 |

FOREIGN PATENT DOCUMENTS

| | | | | |
|---|---|---|---|---|
| DE | 101 62 585 | C1 | 4/2003 | |
| EP | 24 47 977 | A1 | 5/2012 | |
| GB | 734612 | A * | 8/1955 | H01H 50/20 |
| GB | 751 762 | A | 7/1956 | |
| JP | H02-12 725 | A | 1/1990 | |

* cited by examiner

DOUBLE-BREAK RELAY

CROSS-REFERENCE TO RELATED APPLICATIONS

This continuation application claims priority to PCT/EP2014/057713 filed on Apr. 16, 2014 which has published as WO 2014/187620 A1 and also the German application number 10 2013 209 688.7 filed on May 24, 2013, the entire contents of which are fully incorporated herein with these references.

DESCRIPTION

Field of the Invention

The present invention relates to a relay having at least one contact spring which closes or interrupts the electric circuit between two relay connection contacts.

Background of the Invention

DE 101 62 585 C1 discloses a relay having a contact spring which closes or interrupts the electric circuit between two relay connection contacts and of which one spring end is fixed in an electrically conductive manner to the first relay connection contact and the other free spring end can be deflected by means of a solenoid-operated mechanism into a closed relay position abutting the second relay connection contact or into an open relay position lifted from the second relay connection contact.

In DC applications, in particular in vehicles with 24 VDC or 48 VDC, the important aspect is to safely and quickly extinguish the electric arc, which occurs temporarily when the contact spring is deflected into the closed relay position, between the relay contact and the contact spring which is approaching.

An object of the present invention is to reduce the electric arc energy occurring in a relay.

SUMMARY OF THE INVENTION

This object is achieved according to the invention by a relay for closing or interrupting the electric circuit between two relay connection contacts, comprising: two contact springs which are each fixed in an electrically conductive manner to the relay connection contacts with the spring ends thereof facing away from each other and which face each other with the other free, deflectable spring ends thereof; a stationary, electrically conductive contact bridge, against which the free spring ends abut in the closed relay position and from which the free spring ends are lifted in the open relay position; and a single solenoid-operated mechanism for the synchronous, parallel deflection of the two contact springs into the closed or open relay position.

The synchronous double interruption according to the invention of the electric circuit having two series-connected contact springs brings about a halving of the electric arc energy occurring. The contact bridge is retained so as to be fixed in the relay housing and connects the two contact springs in the closed relay position.

The solenoid-operated mechanism is preferably constructed as a lifting magnet having a plunger core which is guided in a linearly movable manner in a magnetic coil and to which the free spring ends are motion-coupled. The solenoid actuator may be constructed in a mono-stable or bi-stable manner. Instead of a solenoid actuator, it is also possible to use a different solenoid-operated mechanism whose positioning element is motion-coupled to the free spring ends in the deflection direction thereof. Thus, for example, a solenoid-operated mechanism can also be used with a rotating armature whose rotational movement results in a deflection of the free spring ends via a coupling element which is guided linearly in a linearly movable manner.

Other advantages and advantageous embodiments of the subject-matter of the invention can be taken from the description, the drawings and the claims. The above-mentioned features and those set out below can also be used individually or together in any combination. The embodiment set out and described should not be understood to be a conclusive listing but is instead of exemplary character for describing the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
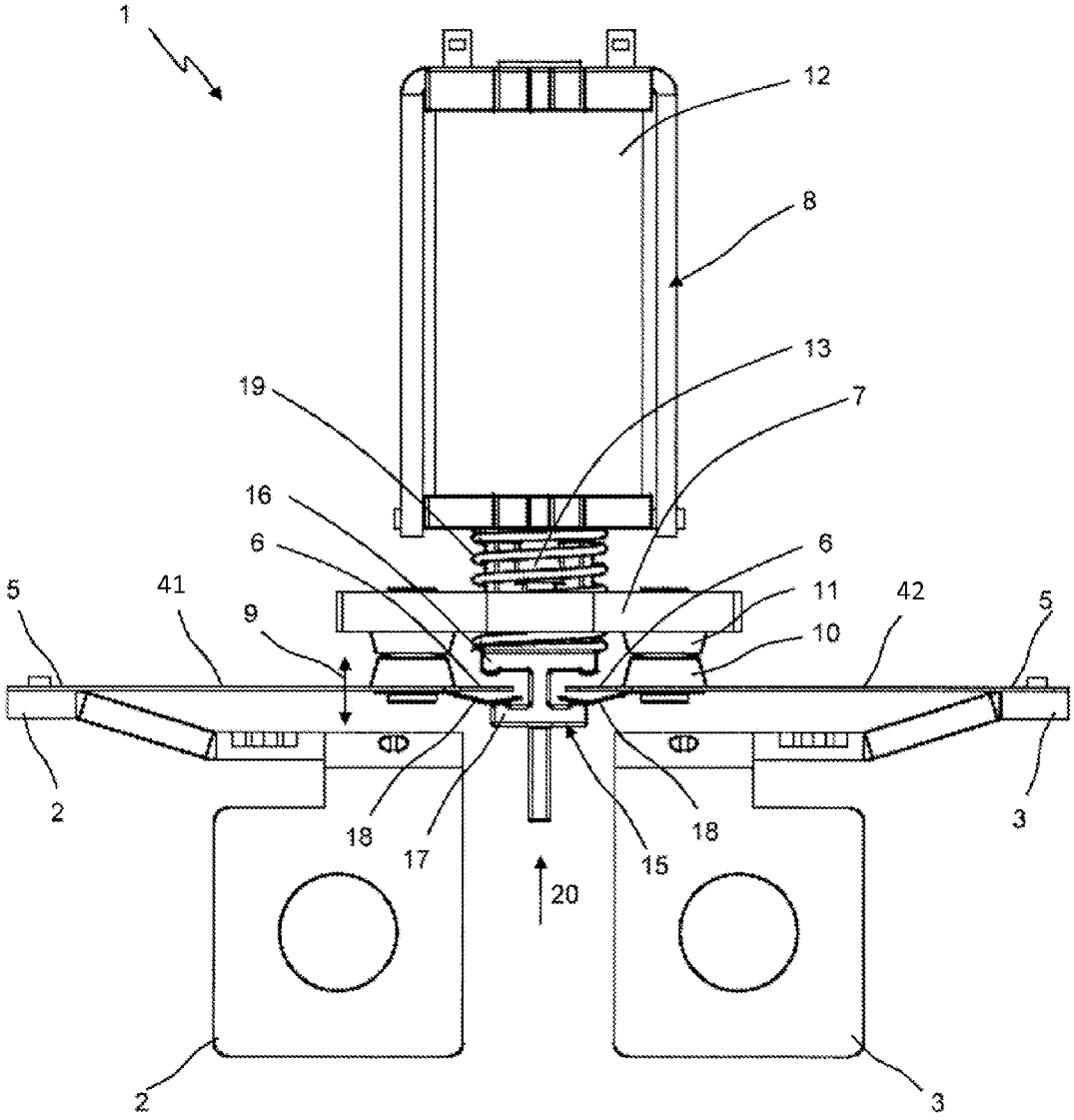
FIG. 1 shows the double-break relay according to the invention in a closed relay position.
Figure 2:
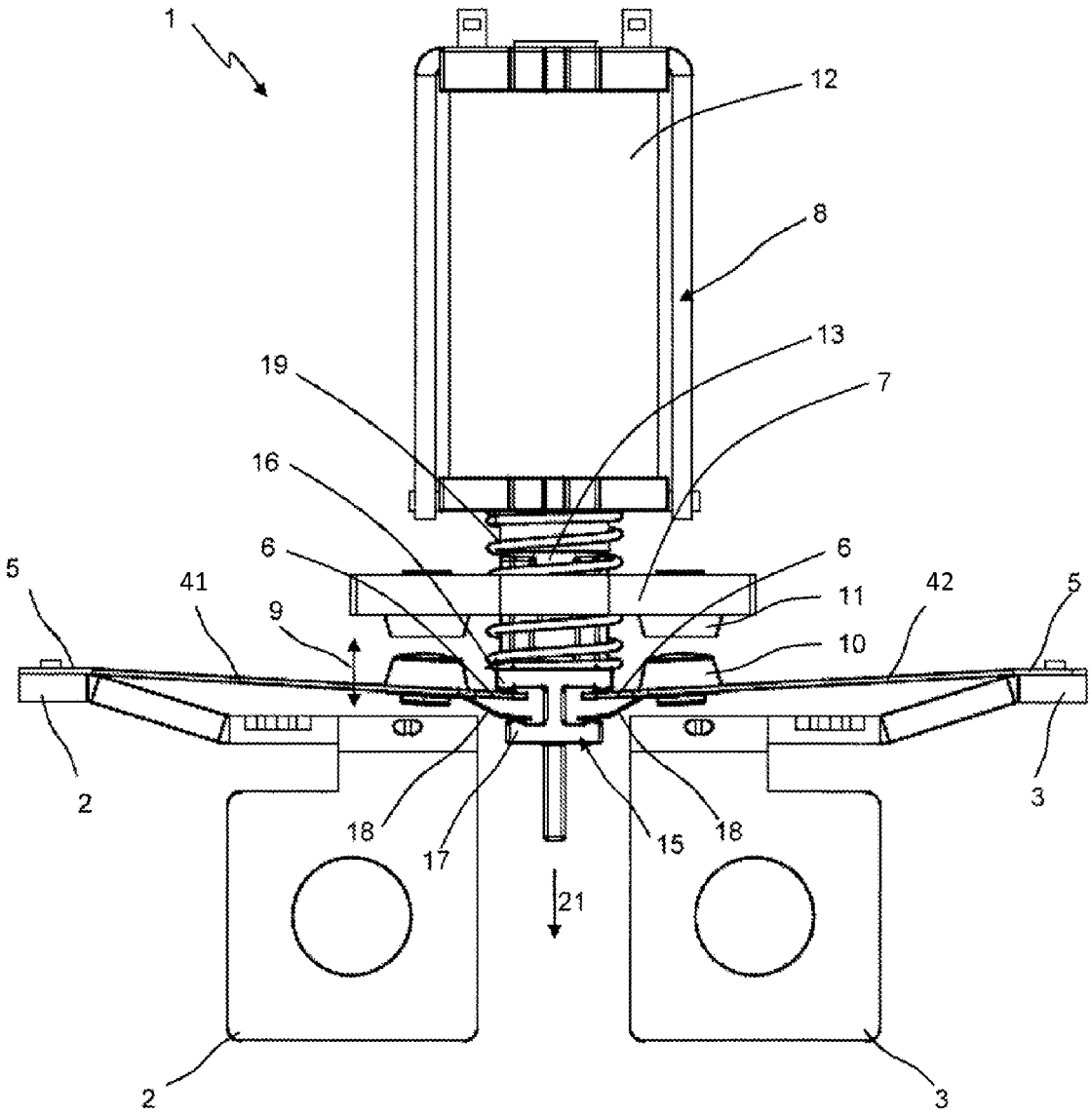
FIG. 2 show the double-break relay according to the invention in an open relay position.

The relay 1 shown in FIGS. 1 and 2 is used to close or interrupt the electric circuit between two electrical relay connection contacts 2, 3.

The relay 1 comprises two contact springs 41, 42 which are each fixed in an electrically conductive manner to the relay connection contacts 2, 3 with the spring ends 5 thereof facing away from each other and which face each other with the other deflectable, free spring ends 6 thereof, an electrically conductive contact bridge 7 (for example, of copper) which is arranged in a stationary manner in the relay housing and against which the free spring ends 6 abut in the closed relay position (FIG. 1) and from which the free spring ends 6 are lifted in the open relay position (FIG. 2), and a solenoid-operated mechanism 8 for the synchronous, parallel deflection of the two contact springs 41, 42 into the closed or open relay position.

The two contact springs 41, 42 are constructed as electrically conductive leaf springs or flat springs (for example, of copper), the free spring ends 6 of which can be deflected in the direction of the double-headed arrow 9. The free spring ends 6 and the contact bridge 7 each have a contact button 10, 11 at the sides thereof facing each other.

The solenoid-operated mechanism 8 is constructed as a mono-stable lifting magnet having a plunger core (tappet) 13 which is guided in a linearly movable manner in a magnetic coil 12 and which carries a carrier head 15 at the end thereof which engages through an opening 14 (FIG. 3) of the contact bridge 7. The carrier head 15 is arranged between the mutually facing free spring ends 6 and has at each of the two sides two carriers (projections) 16, 17 which are spaced apart from each other in a deflection direction 9 and between which the contact springs 41, 42 engage with the free spring ends 6 thereof. A supplementary spring (leaf spring) 18 which is of spring steel and which is supported on the facing lower carrier 17 is fixed to the free spring ends 6 at the side of the contact springs 41, 42 opposite the contact button 10 thereof.

In order to switch the relay 1, the magnetic field of the magnetic coil 12 is switched on or off. The plunger core 13 is, as shown in FIG. 1, drawn upwards into the magnetic coil 8 when the magnetic field is switched on counter to the effect of a pressure spring 19 (closing direction 20) and, as shown in FIG. 2, is urged downwards out of the magnetic coil 8 when the magnetic field is switched off as a result of the force of the pressure spring 18 (opening direction 21).

In the closed relay position shown in FIG. 1, the magnetic field is switched on and the plunger core 13 with the carrier head 15 is displaced upwards, whereby the contact springs 41, 42 are deflected synchronously upwards by means of the supplementary springs 18 thereof by the lower carrier 17 and abut the contact buttons 11 of the contact bridge 7 with the contact studs 10 thereof. The pressing pressure of the contact buttons 10 against the contact buttons 11 is provided by the pressing force of the supplementary spring 18 which is compressed by the lower carrier 17. In the closed relay position, the supplementary springs 18 act counter to the deflection of the contact springs 41, 42 in the opening direction 21, which results in a bounce-reduced closing of the relay 1.

In the open relay position shown in FIG. 2, the magnetic field is switched off and the plunger core 13 with the carrier head 15 is displaced downwards, whereby the contact springs 41, 42 are deflected synchronously downwards by the upper carrier 16 and are lifted off the contact buttons 11 of the contact bridge 7 with the contact buttons 10 thereof.

The synchronous double interruption of the electric circuit by the two contact springs 41, 42 which are connected in series via the contact bridge 7 brings about a halving of the electric arc energy occurring.

Figure 3:
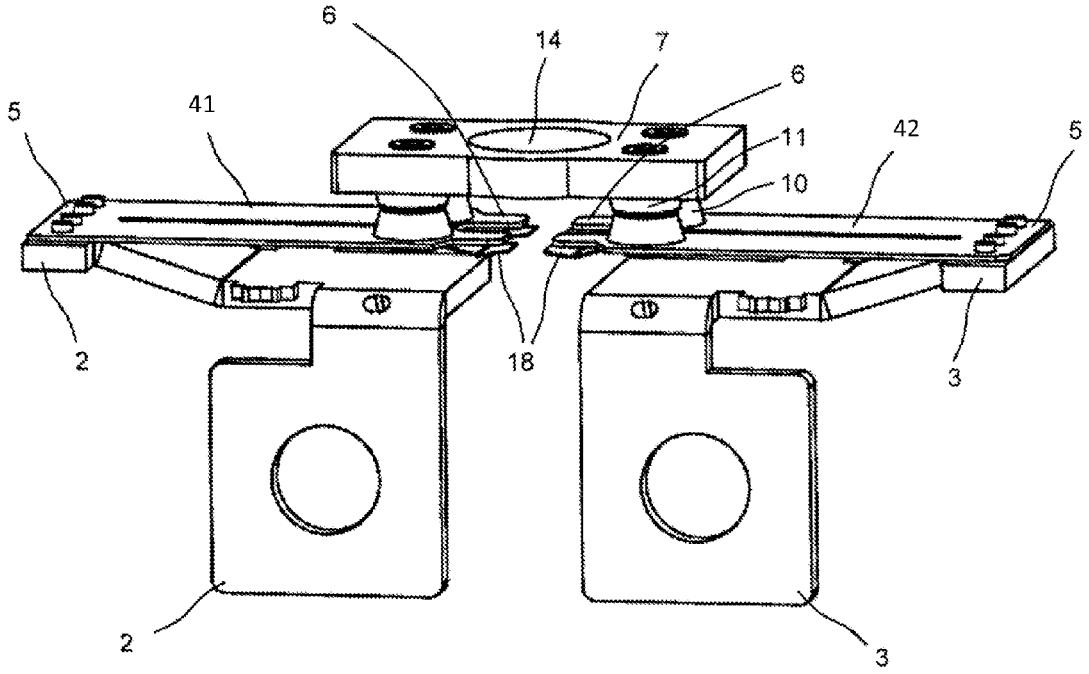
FIG. 3 is a perspective view of the contact set of the relay according to the invention.

As shown in FIG. 3, the two contact springs 41, 42 may each be constructed to be slotted and therefore as parallel double springs.

What is claimed is:

1. A relay for closing or interrupting an electric circuit comprising:

a first stationary relay connection contact;

a second stationary relay connection contact;

a first contact spring having one end fixed in an electrically conductive manner to the first stationary relay connection contact and having a deflectable free spring end opposite to the fixed spring end;

a second contact spring having one end fixed in an electrically conductive manner to the second stationary relay connection contact and having a deflectable free spring end opposite to the fixed spring end;

wherein the fixed spring ends of the first and second contact spring face away from each other and the free spring ends face each other;

a stationary, electrically conductive contact bridge, against which the free spring ends abut in a closed relay position and from which the free spring ends are moved away from the contact bridge in an open relay position; and a single solenoid-operated mechanism for the synchronous, parallel deflection of the two contact springs into the closed or open relay position' wherein the two contact springs are electrically connected to each other via the contact bridge in the closed relay position and are not electrically connected to each other in the open relay position;

wherein the contact bridge is arranged between the free spring ends, on the one hand, and the solenoid-operated mechanism, on the other hand;

wherein the solenoid-operated mechanism is constructed as a lifting magnet having a plunger core which is guided in a linearly movable manner in a magnetic coil and to which the free spring ends are motion-coupled.

2. The relay according to claim 1, wherein the plunger core carries a carrier head which has at each of its two sides two carriers which are spaced apart from each other in a deflection direction of the two contact springs and between which the two contact springs engage with the free spring ends thereof.

3. The relay according to claim 2, wherein the two contact springs are motion-coupled to the solenoid-operated mechanism in the direction towards the closed relay position thereof by means of a supplementary spring which is fixed to each of the two contact springs.

4. The relay according to claim 3, wherein the contact bridge has an opening, through which a positioning element of the solenoid-operated mechanism engages.

5. The relay according to claim 1, wherein the plunger core carries a carrier head which has at each of its two sides two carriers which are spaced apart from each other in a deflection direction of the two contact springs and between which the two contact springs engage with the free spring ends thereof.

6. The relay according to claim 1, wherein the two contact springs are motion-coupled to the solenoid-operated mechanism in the direction towards the closed relay position thereof by means of a supplementary spring which is fixed to each of the two contact springs.

7. The relay according to claim 1, wherein the contact bridge has an opening, through which a positioning element of the solenoid-operated mechanism engages.

8. A relay for closing or interrupting an electric circuit, comprising:

a first stationary relay connection contact;

a second stationary relay connection contact;

a first contact spring having one end fixed in an electrically conductive manner to the first stationary relay connection contact and having a deflectable free spring end opposite to the fixed spring end;

a second contact spring having one end fixed in an electrically conductive manner to the second stationary relay connection contact and having a deflectable free spring end opposite to the fixed spring end;

wherein the fixed spring ends face away from each other and wherein the free spring ends face each other;

a stationary, electrically conductive contact bridge disposed adjacent to the free spring ends;

a single solenoid-operated mechanism attached to the contract bridge, the solenoid-operated mechanism configured for the synchronous, parallel deflection of the free spring ends of the two contact springs into a closed or an open relay position;

wherein the free spring ends are in electrical conductivity with the contact bridge in the closed relay position and wherein the free spring ends are not in electrical conductivity with the contact bridge in the open relay position;

wherein the solenoid-operated mechanism is constructed as a lifting magnet having a plunger core which is guided in a linearly movable manner in a magnetic coil and to which the free spring ends are motion-coupled.

9. A relay for closing or interrupting an electric circuit, comprising:

a first stationary relay connection contact;

a second stationary relay connection contact;

a first contact spring having one end fixed in an electrically conductive manner to the first stationary relay connection contact and having a deflectable free spring end opposite to the fixed spring end;

a second contact spring having one end fixed in an electrically conductive manner to the second stationary relay connection contact and having a deflectable free spring end opposite to the fixed spring end;

wherein the fixed spring ends of the first and second contact spring face away from each other and the free spring ends face each other;

a stationary, electrically conductive contact bridge, against which the free spring ends abut in the closed relay position and from which the free spring ends are lifted in the open relay position; and a single solenoid-operated mechanism for the synchronous, parallel deflection of the two contact springs into the closed or open relay position;

wherein the two contact springs are motion-coupled to the solenoid-operated mechanism in the direction towards the closed relay position thereof by means of a supplementary spring which is fixed to each of the two contact springs.

* * * * *